United States Patent [19]

Ito et al.

[11] 4,279,648

[45] Jul. 21, 1981

[54] HIGH SILICON CHROMIUM NICKEL STEEL FOR STRONG NITRIC ACID

[75] Inventors: Naoya Ito; Kiichi Saito; Takeshi Yoshida; Masahiro Aoki, all of Joetsu; Masao Okubo; Masayoshi Miki, both of Niihama, all of Japan

[73] Assignees: Sumitomo Chemical Company, Limited, Osaka; Nippon Stainless Steel Co., Ltd., Tokyo, both of Japan

[21] Appl. No.: 103,922

[22] Filed: Dec. 17, 1979

[30] Foreign Application Priority Data

Dec. 28, 1978 [JP] Japan ..... 53-163014

[51] Int. Cl.[3] ..... F16J 3/04; C22C 38/02; C22C 38/48; C22C 38/50

[52] U.S. Cl. ..... 75/128 C; 75/128 A; 75/128 T; 75/128 Z

[58] Field of Search ..... 75/128 C, 128 A, 128 T, 75/128 Z

[56] References Cited

U.S. PATENT DOCUMENTS

| | | | |
|---|---|---|---|
| 3,615,368 | 10/1971 | Bäumel | 75/128 A |
| 3,663,215 | 5/1972 | Tanczyn | 75/128 C |
| 3,785,787 | 1/1974 | Yokota et al. | 29/196.1 |
| 4,000,984 | 1/1977 | Bäumel | 29/183 |
| 4,039,356 | 8/1977 | Schumacher et al. | 148/31.5 |
| 4,099,967 | 7/1978 | Schumacher et al. | 75/128 A |
| 4,102,225 | 7/1978 | Michels | 75/124 |
| 4,108,641 | 8/1978 | Fujioka et al. | 75/124 |
| 4,171,218 | 10/1979 | Hoshino et al. | 75/128 C |

FOREIGN PATENT DOCUMENTS

| | | |
|---|---|---|
| 1261800 | 1/1972 | United Kingdom . |
| 43-19746 | 8/1968 | Japan . |
| 50-4605 | 2/1975 | Japan . |
| 50-72813 | 6/1975 | Japan . |

OTHER PUBLICATIONS

Nippon Kinzoku Gakaishi, vol. 16, No. 3, p. 188.

*Primary Examiner*—L. Dewayne Rutledge
*Assistant Examiner*—Upendra Roy
*Attorney, Agent, or Firm*—Stevens, Davis, Miller & Mosher

[57] ABSTRACT

A high-silicon-nickel-chromium steel resistant to concentrated nitric acid with a good workability and a good weldability, comprising carbon in an amount of not more than 0.03% ($C \leqq 0.03\%$), silicon in an amount of from more than 5% to not more than 7% ($5\% < Si \leqq 7\%$), manganese in an amount of not more than 10% ($Mn \leqq 10\%$), chromium in an amount of from not less than 7% to not more than 16% ($7\% \leqq Cr \leqq 16\%$), nickel in an amount of from not less than 10% to less than 19% ($10\% \leqq Ni \leqq 19\%$), and the balance being iron and inevitable impurities, percentages being by weight.

5 Claims, 10 Drawing Figures

NOTE : FIGURES SHOW A CORROSION RATE ($g / m^2 \cdot hr$)

NOTE:
× = MANY CRACKS
△ = A FEW CRACKS
○ = NO CRACKS

NOTE:
× = GOOD PROCESSABILITY BELOW 1100°C
△ = GOOD PROCESSABILITY BELOW 1150°C
○ = GOOD PROCESSABILITY BELOW 1225°C
⊗ = GOOD PROCESSABILITY BELOW 1225°C, BUT BRITTLE CRACKS OCCURRED IN THE COURSE OF COOLING
◎ = GOOD PROCESSABILITY BELOW 1250°C

HIGH SILICON CHROMIUM NICKEL STEEL FOR STRONG NITRIC ACID

This invention relates to metallic materials having good workability and good weldability suitable for apparatuses for producing, treating and using nitric acid of a high concentration at a high temperature.

Recently, the concentration and temperature of process nitric acid streams have been more and more increased in apparatuses for producing, treating and using nitric acid, and the conventional materials of construction for the apparatuses have been not satisfactory, and consequently the development and improvement of processes relevant to nitric acid have been considerably restricted by the troubles due to the materials of construction for the apparatuses.

Nitric acid having a concentration above that of the azeotropic composition is generally decomposed by heating to generate NOx as vapors. Consequently, a strong oxidizing atmosphere of fuming nitric acid becomes dominant not only at the liquid phase area but also at the gas phase area, and corrosiveness is considerably increased thereby. These phenomena are remarkable at high temperatures, for example, at the boiling temperature.

As the materials of construction for apparatuses for concentrated nitric acid, aluminum, titanium, high silicon cast iron, glass-lined steel, 16Cr-14Ni-4Si stainless steel, etc. have been used. However, aluminum has a low strength, and is very easily corroded by nitric acid having a concentration of 95% by weight or lower, and also no longer has practical corrosion resistance to 98% by weight concentrated nitric acid at a temperature of 40° C. or higher. Titanium is expensive and has fatal dangers such as stress corrosion cracking and ignition explosion as regards fuming nitric acid.

High silicon cast iron and glass-lined steel cannot be welded, and thus it is difficult to fabricate an apparatus of large size. They are also brittle and less resistant to impact.

As for 16Cr-15Ni-4Si stainless steel, the solubility of carbon in the matrix is lowered due to a high silicon content. That is, carbides are liable to precipitate at the welding or other thermal operations, and the corrosion resistance is considerably deteriorated thereby. Such deterioration of the steel in the corrosion resistance is most prominent at a temperature of about 650° C., if the retention is restricted to a short period of time, and it is known as sensitization phenomenon.

Recently, several stainless steels with high corrosion resistances such as a high resistance to stress corrosion cracking and a high resistance to general corrosion have been reported. For example, Nippon Kinzoku Gakkai Kaiho 16 No. 3, 188 (1977) discloses a high nickel steel with an improved resistance to concentrated nitric acid by increasing the silicon content (0.02% C, 0.6% Mn, 7.0–9.0% Cr, 19.0–22.0% Ni, and 5.5–6.5% Si), which is, however, poor in hot workability to thereby generate cracks, and lower the yield of steel plates, and also is high in nickel content and therefore it becomes expensive. Furthermore, troubles such as cracking, etc. are more liable to appear at the product working owing to poor weldability, and the corrosion resistance is also lowered by sensitization due to thermal operations such as welding, hot rolling, etc.

Japanese Patent Publication No. 19746/68 discloses a high silicon stainless steel with a high resistance to stress corrosion cracking and a high resistance to general corrosion, and Japanese Patent Publication No. 4605/75 discloses a stainless steel with a high resistance to general corrosion, a high resistance to stress corrosion cracking susceptibility, and a resistance to welding cracking at the same time. It is disclosed that they are excellent in resistance to stress corrosion cracking in a chloride atmosphere and resistance to general corrosion in sulfuric acid and hydrochloric acid atmospheres, but they are poor in the workability and weldability, and thus are less practical.

British Pat. No. 1,261,809 discloses that a high strength silicon steel has a good corrosion resistance to relatively dilute acids such as dilute hydrochloric acid, dilute sulfuric acid, dilute aqua regia, etc. However, the steel is also poor in the workability and weldability, and thus is less practical.

As described above, these high silicon steels may have a good corrosion resistance in the concerned corroding atmospheres, but there is disclosed no steel meeting all of corrosion resistance in a strong oxidizing concentrated nitric acid atmosphere, workability and weldability.

The present inventors had been making studies of developing materials capable of withstanding concentrated nitric acid with a very high oxidizing strength and a high corrosivity and having a good workability and a good weldability, and developed a stainless steel resistant to the concentrated nitric acid (as disclosed in Japanese Patent Application Kokai (Laid-open) No. 72813/75), which has much better properties than those of the conventional materials resistant to the concentrated nitric acid and can be used almost in any nitric acid atmosphere, but further development of a material resistant to concentrated nitric acid and capable of being used in a more severe nitric acid atmosphere stably for a prolonged period of time and withstanding the sensitization by heat treatments such as welding, hot rolling, etc. has been desired.

As a result of further extensive studies of the materials, the present inventors have found a material resistant to concentrated nitric acid with a much better workability, a much better weldability and a much better corrosion resistance (even the sensitized material has a good resistance).

The present invention provides a high-silicon-nickel-chromium steel resistant to concentrated nitric acid with a good workability and a good weldability, comprising carbon in an amount of not more than 0.03% ($C \leqq 0.03\%$), silicon in an amount of from more than 5% to not more than 7% ($5\% < Si \leqq 7\%$), manganese in an amount of not more than 10% ($Mn \leqq 10\%$), chromium in an amount of from not less than 7% to not more than 16% ($7\% \leqq Cr \leqq 16\%$), nickel in an amount of from not less than 10% to less than 19% ($10\% \leqq Ni < 19\%$), and the balance being iron and inevitable impurities, percentages being by weight (this steel being hereinafter referred to as "present basic steel").

The present invention further provides a high silicon-nickel-chromium steel resistant to concentrated nitric acid with a good workability and a good weldability comprising carbon in an amount of not more than 0.03% ($C \leqq 0.03\%$), silicon in an amount of from more than 5% to not more than 7% ($5\% < Si \leqq 7\%$), manganese in an amount of not more than 10% ($Mn \leqq 10\%$), chromium in an amount of from not less than 7% to not more than 16% ($7\% \leqq Cr \leqq 16\%$), nickel in an amount of from not less than 10% to less than 19% ($10\% \leqq Ni \leqq 19\%$), at least one member selected from the group consisting of titanium (Ti), tantalum (Ta), zirconium (Zr) and niobium (Nb) in an amount of from not less than 4 times the amount of carbon to not more than 2% [$C(\%) \times 4 \leqq$ at least one member of Ti, Ta, Zr and $Nb \leqq 2\%$].

and the balance being iron and inevitable impurities, percentages being by weight.

The present invention further provides a process for preventing corrosion of an apparatus which is brought into contact with concentrated nitric acid in the gas phase or liquid phase at a high temperature, comprising using the above-mentioned steel of the present invention for the apparatus.

The present invention will be described below, referring to the accompanying drawings, where:

Figure 1:
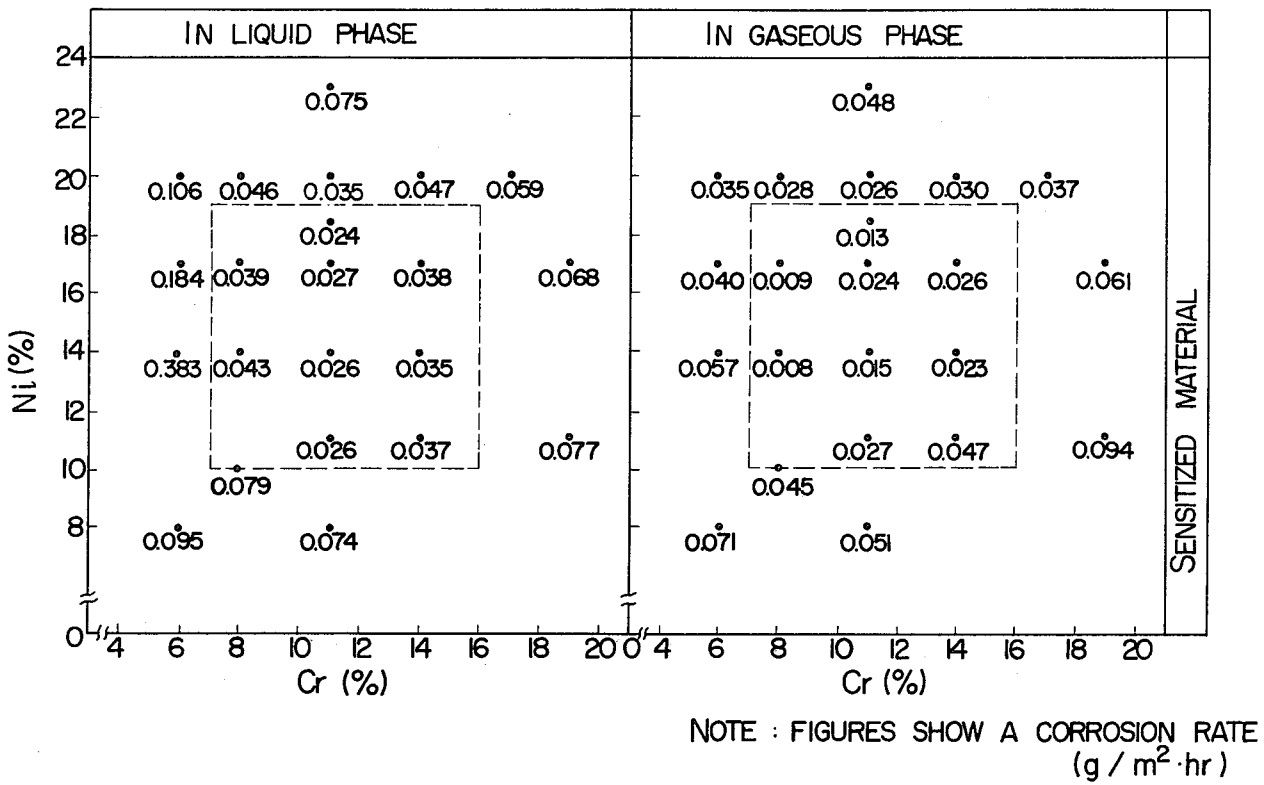
FIG. 1 is a diagram showing average corrosion rates of sensitized steel materials having constant C, Mn and Si contents and varied Ni and Cr contents in a liquid phase and a gas phase of 98% concentrated nitric acid at 60° C.

Sensitized materials of steel species having constant contents of C (0.018 wt. %), Mn (0.6 wt. %) and Si (6 wt. %) and different contents of Ni and Cr (sensitized at 650° C. for 2 hours, and then air-cooled) were subjected to 5 repetitions of a corrosion test in a liquid phase and a gas phase of 98% concentrated nitric acid at 60° C. for 168 hr for one repetition, and average corrosion rates ($g/m^2.hr$) of the fourth repetition and fifth repetition are shown in FIG. 1 (the test solution was replaced with a fresh one for every repetition).

The present steel has a lower Cr content than the Cr and Ni balance of ordinary austenitic stainless steel. Generally speaking, the lower Cr content deteriorates the corrosion resistance, but the present high silicon steel has a good corrosion resistance in the concentrated nitric acid as shown in FIG. 1, and also has a good hot workability which is most important for production of materials in sheet and plate forms, and a good weldability and good mechanical properties, comparable to those of the ordinary austenitic stainless steel. As shown in FIG. 1, a considerably good corrosion resistance can be obtained in the range of $7\% \leqq Cr \leqq 16\%$ by weight and $10\% \leqq Ni < 19\%$ by weight.

Figure 2:
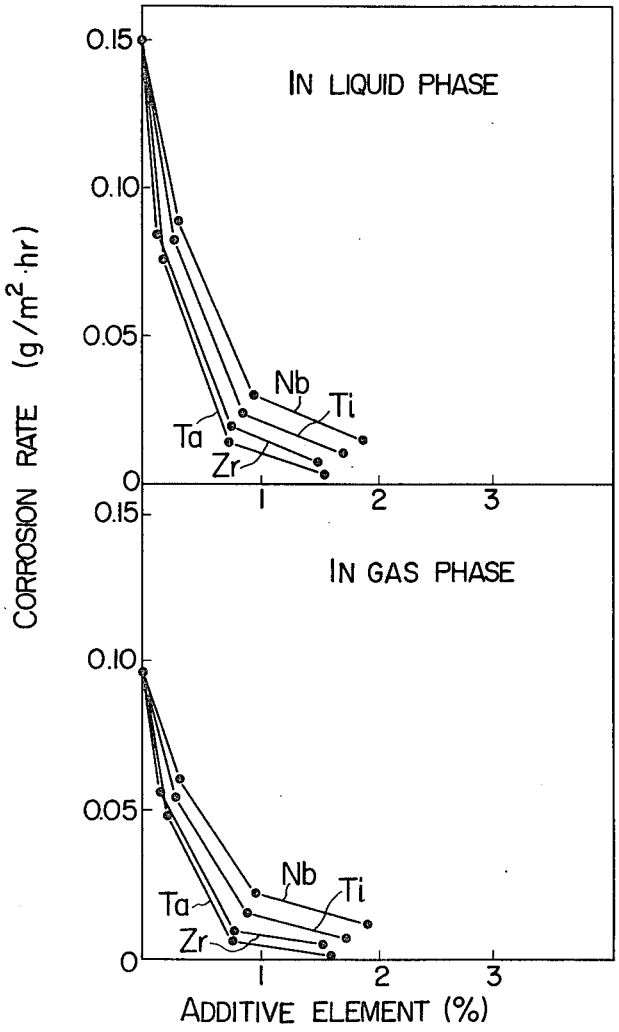
FIG. 2 is a diagram showing relations between the amount of additive element added to the present basic steel containing basic composition of the present invention and corrosion rates.

FIG. 2 shows relations between the amount of Zr, Ti, Nb or Ta added to the present basic steel (No. 5) and corrosion rates (said steel No. and those which will appear hereinafter correspond to those shown in Table 2 described below). As is evident from FIG. 2, the corrosion resistance can be considerably improved by addition of these components.

Surfaces of 10 kg-blocks of 14 steels (Nos. 1, 3, 6, 8, 14, 25, 26, 28, 29, 30, 31, 32, 33 and 34) based on combinations of varied Cr and Ni contents were machined flat and subjected to bead-on-plate welding, and the presence of cracks was investigated by penetrant test.

Figure 3:
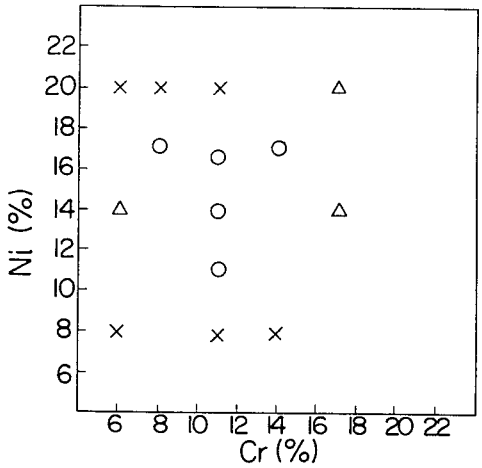
FIG. 3 is a diagram showing results of bead-on-plate tests for evaluating welding crack susceptibility of 14 steels based on varied combinations of Cr and Ni.

The results of the above-mentioned bead-on-plate tests showing evaluation of welding crack susceptibility are given in FIG. 3. Appearances of typical test pieces used in the bead-on-plate tests are shown in FIG. 4, where FIG. 4(*a*) shows the present steel (No. 3), and FIG. 4(*b*) shows a reference steel (No. 33), and FIG. 4(*c*) a reference steel (No. 29).

Figure 4C:
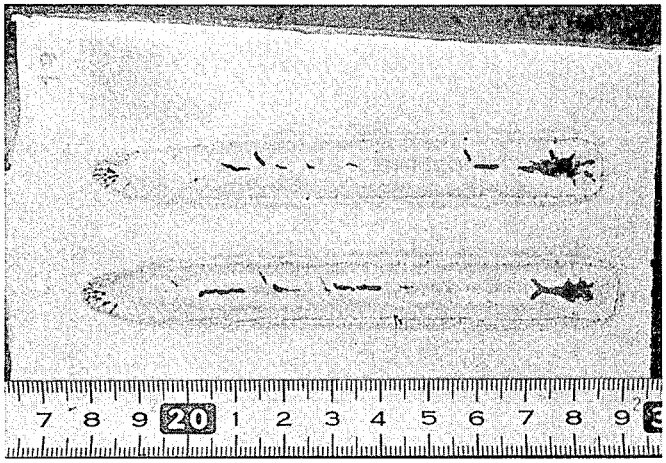
FIGS. 4 and 5 show appearances of typical test pieces subjected to bead-on-plate tests, where FIG. 4(*a*) shows the steel of the present invention (No. 3), and FIGS. 4(*b*) and (*c*) show the reference steels (No. 33 and No. 29), and FIGS. 5(*a*) and (*b*) show the steels of the present invention (No. 24 and No. 17).
Figure 4B:
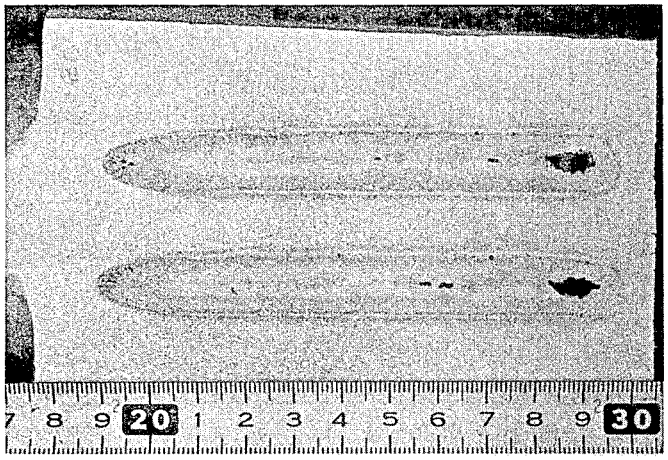
Figure 4A:
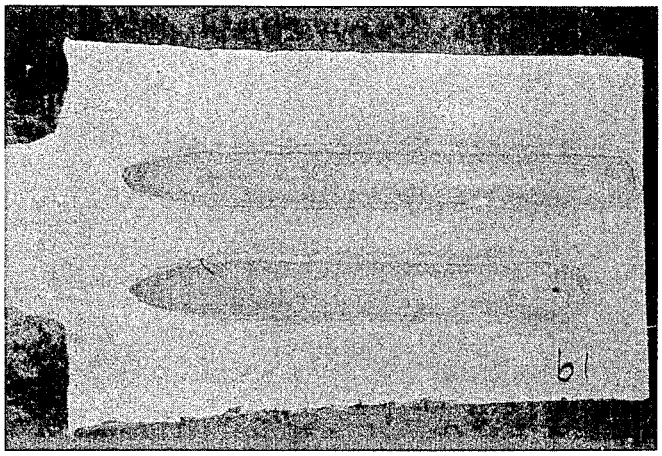

As shown in FIG. 3, a clear difference is observed in the welding crack susceptibility depending upon the Cr and Ni contents, and no welding cracks appear in the range of $7\% \leqq Cr \leqq 16\%$ by weight and $10\% \leqq Ni < 19\%$ by weight, as is evident from the appearances shown in FIG. 4.

Figure 5B:
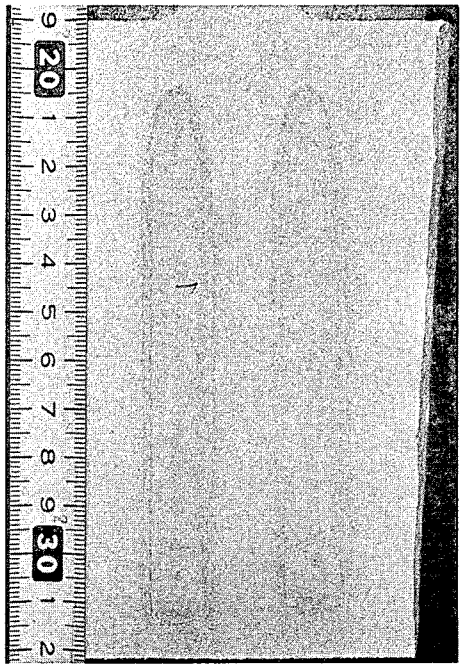
Figure 5A:
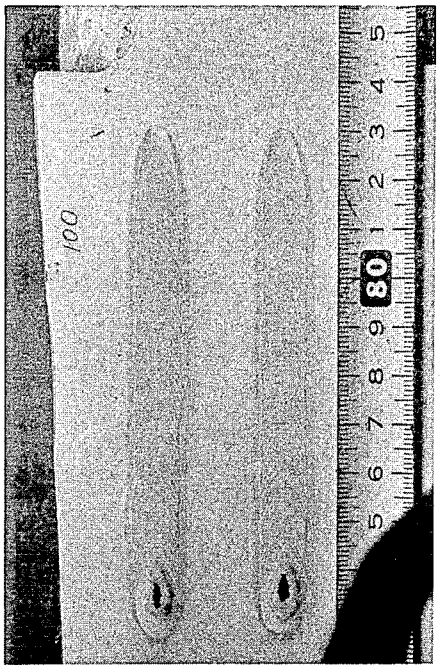

FIG. 5 shows appearances of steel pieces containing at least one of Zr, Ti, Nb and Ta in addition to the composition of the present basic steel, subjected to the bead-on-plate tests. As is evident from FIG. 5, no welding cracks appear, where FIG. 5(*a*) shows the present steel (No. 24) and FIG. 5(*b*) the present steel (No. 17).

Steel blocks of 15 steels based on combinations of varied Cr and Ni contents (Nos.1, 3, 6, 8, 14, 15, 25, 26, 28, 29, 30, 31, 32, 33 and 34) were cut in parallel with columnar crystals of the blocks to prepare test pieces of 13 mm in diameter and 15 mm in height, and the test pieces were heated at 1,000°-1,300° C. for 30 minutes, and subjected to 40% compression working by one stroke according to a drop hammer test, where the hot workability was evaluated by the degree of cracks developed at one side of the deformed test pieces. The results are shown in FIG. 6.

Figure 6:
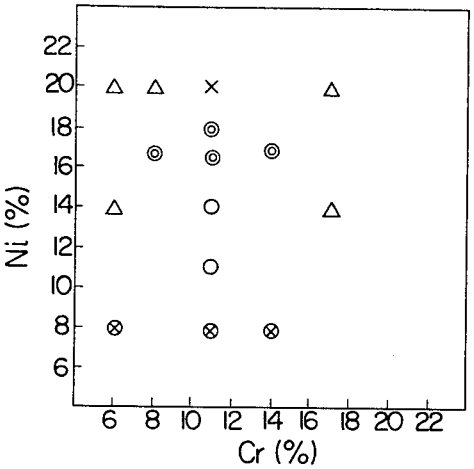
FIG. 6 is a diagram showing results of drop hammer tests for evaluating hot workability of 15 steels based on varied combinations of Cr and Ni.

As is evident from FIG. 6, the present steel has a good hot workability in the range of $7\% \leqq Cr \leqq 16\%$ by weight and $10\% \leqq Ni < 19\%$ by weight. The steel having the Ni content of less than 10% by weight hardly deforms during the hot working, but cracks appear at the cooling step after the hot working. It seems that the martensite structure becomes dominant, and the test pieces become brittle to bring about cracks. On the other hand, the hot workability is excellent in the range of $10\% \leqq Ni < 19\%$ by weight, and particularly a temperature range for good hot workability becomes less than 1,250° C. in the range of $16\% \leqq Ni \leqq 18\%$ by weight. That is, the best hot workability can be obtained. At the Ni content of 19% by weight or higher, the hot workability is liable to be deteriorated. The test piece with the mark "X" in FIG. 6 has a poor hot workability and requires many time repetitions of heating practice to produce good products in an industrial scale production. That is, the number of workings is undesirably increased.

The steel containing at least one element of Zr, Ti, Nb, and Ta in addition to the composition of the present basic steel has a good hot workability, and particularly the steel containing Zr and Ti has a further improved hot workability.

Figure 7:
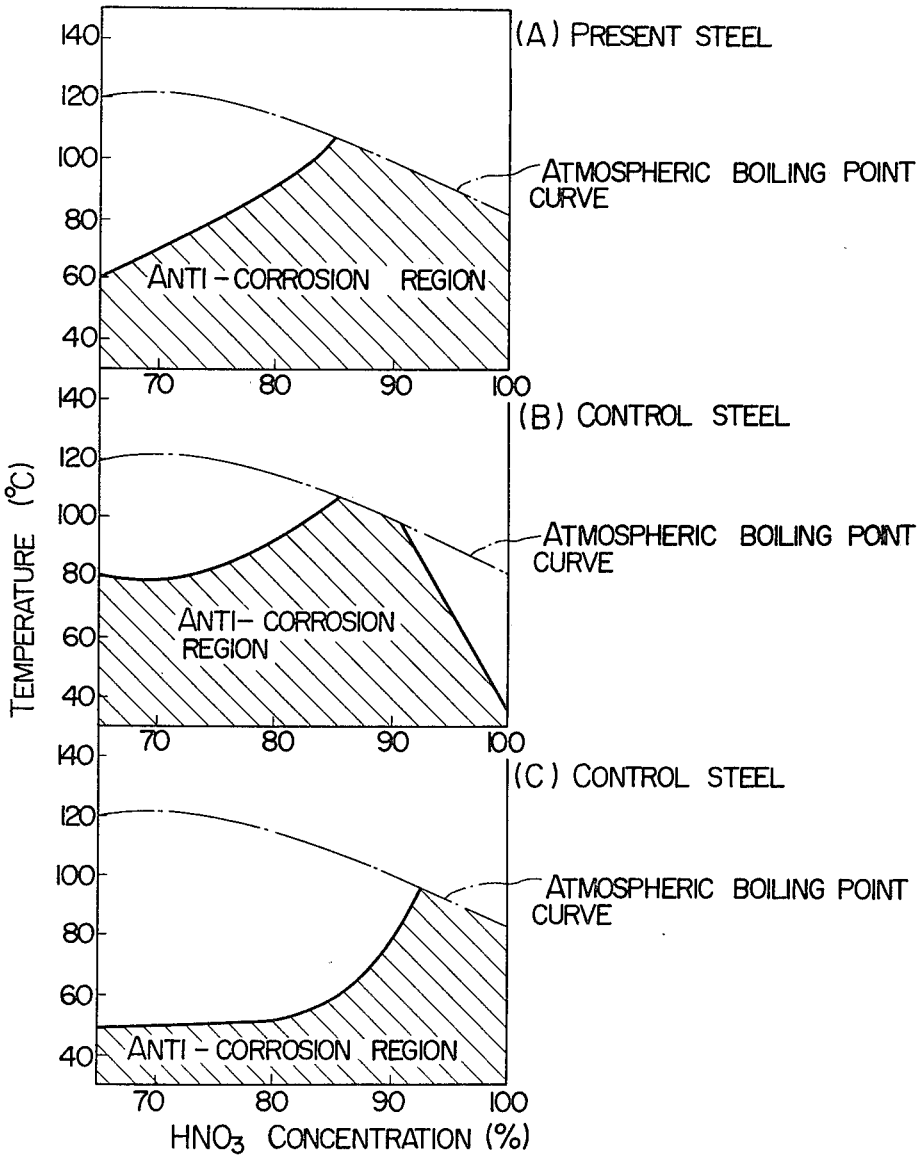
FIG. 7 is a diagram showing corrosion-resistant regions of the present steel (a) (No. 14) and reference steels (b) (No. 40) and (c) (No. 39) in a nitric acid atmosphere.

5 repetitions of a corrosion test for sensitized materials (sensitized at 650° C. for 2 hours and then air-cooled) of the present steel "A" (No. 4), reference steel "B" (No. 40), and reference steel "C" (No. 39) in nitric acid of varied concentrations at varied temperatures for 20 hours for one repetition were carried out, and the higher average values within corrosion rates of the fourth repetition and the fifth repetition each in the liquid phase and the gas phase are given in FIG. 7 as the anti-corrosion region showing the average value is less than 0.1 g/m$^2$.hr. As is evident from FIG. 7, the present steel shows a good corrosion resistance in a wide range. More specifically, it has a wider anti-corrosion region in the nitric acid atmosphere at a high temperature of 80° to 100° C. and at a high concentration of, for example, 70% or higher, and a better corrosion resistance at a higher concentration side of nitric acid, as compared with the reference steels.

Mechanical properties of the present steel are given in Table 1, where the 0.2% proof strength is 25 kg/mm$^2$ or higher, the tensile strength 70 kg/mm$^2$ or higher, and the elongation 35% or higher, though somewhat dependent upon combinations of Cr and Ni contents, and are well equal to those of reference steels shown together therewith in Table 1. Thus, the present steel has practically satisfactory mechanical strength and elongation.

Compositions of various steels shown in Table 1 are given in Table 2, where compositions of various other steels used in Examples are given together therewith.

TABLE 1

| | 2 mm thick solution treated material (1,050° C. × 15 min, and then air-cooled) Test piece: JIS 13B | | | | |
|---|---|---|---|---|---|
| No. | Test piece | 0.2% proof strength (kg/mm$^2$) | Tensile strength (kg/mm$^2$) | Elongation (%) | Hardness ($H_RB$) |
| 25 | Reference steel | 92.4 | 140.6 | 33.8 | 112.0 |
| 28 | " | 25.8 | 69.2 | 63.0 | 75.3 |
| 26 | Invention | 26.1 | 60.4 | 69.0 | 79.6 |
| 27 | " | 27.3 | 115.5 | 39.2 | 88.2 |
| 30 | Reference steel | 23.4 | 69.6 | 70.0 | 76.5 |
| 5 | Invention | 27.4 | 71.7 | 64.8 | 81.0 |
| 6 | " | 29.1 | 90.5 | 58.8 | 88.2 |
| 31 | Reference steel | 61.4 | 126.5 | 27.4 | 105.0 |
| 8 | Invention | 28.7 | 72.0 | 66.0 | 84.0 |
| 9 | " | 49.9 | 109.8 | 42.6 | 101.4 |
| 33 | Reference steel | 29.3 | 73.0 | 69.6 | 82.0 |
| 19 | Invention | 30.2 | 73.4 | 60.5 | 96.0 |
| 16 | " | 29.3 | 71.9 | 62.7 | 95.0 |
| 20 | " | 31.2 | 74.7 | 59.3 | 96.0 |

TABLE 2

| No. | C | Si | Mn | Cr | Ni | Mo | Cu | Ti | Ta | Zr | Nb | Remark |
|---|---|---|---|---|---|---|---|---|---|---|---|---|
| 1 | 0.017 | 6.16 | 0.59 | 7.91 | 16.98 | | | | | | | Invention |
| 2 | 0.014 | 6.12 | 0.58 | 3.00 | 13.86 | | | | | | | " |
| 3 | 0.017 | 6.08 | 0.76 | 11.08 | 10.79 | | | | | | | " |
| 4 | 0.015 | 5.88 | 0.58 | 11.14 | 17.06 | | | | | | | " |
| 5 | 0.016 | 5.86 | 0.62 | 11.14 | 18.50 | | | | | | | " |
| 6 | 0.016 | 5.74 | 0.64 | 11.16 | 13.99 | | | | | | | " |
| 7 | 0.014 | 5.97 | 0.61 | 11.18 | 14.08 | | | | | | | " |
| 8 | 0.015 | 5.76 | 0.58 | 13.95 | 16.78 | | | | | | | " |
| 9 | 0.017 | 6.19 | 0.73 | 14.12 | 10.87 | | | | | | | " |
| 10 | 0.014 | 6.03 | 1.41 | 11.31 | 13.51 | | | | | | | " |
| 11 | 0.019 | 6.11 | 2.86 | 11.11 | 12.99 | | | | | | | " |
| 12 | 0.019 | 5.91 | 5.51 | 10.87 | 11.35 | | | | | | | " |
| 13 | 0.015 | 6.00 | 8.92 | 10.91 | 10.03 | | | | | | | " |
| 14 | 0.016 | 6.05 | 0.61 | 11.10 | 16.60 | | | | | | | " |
| 15 | 0.019 | 5.96 | 0.59 | 11.03 | 18.05 | | | | | | | " |
| 16 | 0.018 | 6.26 | 0.59 | 11.15 | 18.46 | | | 0.92 | | | | " |
| 17 | 0.016 | 5.94 | 0.61 | 11.15 | 13.87 | | | 1.17 | | | | " |
| 18 | 0.014 | 6.11 | 0.62 | 10.87 | 18.36 | | | | 0.76 | | | " |
| 19 | 0.016 | 6.55 | 0.60 | 11.31 | 18.61 | | | | | 0.56 | | " |
| 20 | 0.014 | 6.55 | 0.58 | 11.06 | 18.48 | | | | | | 1.12 | " |
| 21 | 0.016 | 5.99 | 0.68 | 10.99 | 18.68 | | | 0.15 | | 0.81 | | " |
| 22 | 0.013 | 5.99 | 0.59 | 11.05 | 18.46 | | | 0.10 | | | 0.25 | " |
| 23 | 0.018 | 5.92 | 0.62 | 11.12 | 18.55 | | | | 0.11 | | 0.63 | " |
| 24 | 0.017 | 6.03 | 0.60 | 11.02 | 16.47 | | | 0.09 | | 0.70 | | " |
| 25 | 0.014 | 5.94 | 0.83 | 5.82 | 7.97 | | | | | | | Reference steel |
| 26 | 0.018 | 6.14 | 0.60 | 6.05 | 17.01 | | | | | | | Reference steel |
| 27 | 0.020 | 6.08 | 0.58 | 6.07 | 18.89 | | | | | | | Reference steel |
| 28 | 0.018 | 6.11 | 0.58 | 6.10 | 20.06 | | | | | | | Reference steel |
| 29 | 0.017 | 6.17 | 0.58 | 7.96 | 19.9 | | | | | | | Reference steel |
| 30 | 0.015 | 6.04 | 0.60 | 10.87 | 19.87 | | | | | | | Reference steel |
| 31 | 0.016 | 6.08 | 0.79 | 11.84 | 8.01 | | | | | | | Reference steel |
| 32 | 0.016 | 6.08 | 0.76 | 13.99 | 8.09 | | | | | | | Reference steel |
| 33 | 0.016 | 6.07 | 0.59 | 16.98 | 19.97 | | | | | | | Reference steel |
| 34 | 0.016 | 6.08 | 0.71 | 17.12 | 18.70 | | | | | | | Reference steel |
| 35 | 0.020 | 2.02 | 0.68 | 11.21 | 18.68 | | | | | | | Reference steel |
| 36 | 0.018 | 3.91 | 0.64 | 11.06 | 19.02 | | | | | | | Reference steel |

TABLE 2-continued

| No. | C | Si | Mn | Cr | Ni | Mo | Cu | Ti | Ta | Zr | Nb | Remark |
|---|---|---|---|---|---|---|---|---|---|---|---|---|
| 37 | 0.018 | 5.89 | 12.76 | 11.03 | 7.86 | | | | | | | Reference steel |
| 38 | 0.018 | 6.05 | 14.13 | 11.21 | 7.02 | | | | | | | Reference steel |
| 39 | 0.012 | 5.8 | 0.58 | 8.06 | 20.06 | | | | | | | Reference steel |
| 40 | 0.018 | 4.16 | 1.08 | 17.28 | 14.32 | 0.19 | 0.28 | | | | 0.79 | Reference steel |
| 41 | 0.018 | 3.94 | 1.19 | 16.76 | 13.87 | 0.26 | 0.10 | | | | | Reference steel |
| Carpenter 20 | 0.05 | 0.43 | 1.37 | 20.18 | 29.43 | 2.85 | 2.22 | | | | 0.60 | Reference steel |
| SUS 304L | 0.02 | 0.66 | 1.57 | 18.69 | 10.45 | | | | | | | Reference steel |
| 1070 aluminum | | | | | | | | | | | | Reference material |
| 5052 aluminum | | | | | | | | | | | | Reference material |

The reasons why the components are restricted to the ranges as mentioned above in the present invention will be described below:

C: The corrosion resistance is increased with decreasing C content, but the C content on the steel making level for economically readily lowering the C content is 0.03% by weight or less. The present steel has a sufficiently good corrosion resistance, and thus the C content is defined to be 0.03% by weight or less, preferably 0.02% by weight or less.

Si: The important element for the corrosion resistance to nitric acid of a high concentration is Si. A silicate film is formed on the surface of the steel, thereby improving the corrosion resistance. At or below a Si content of 5% by weight, the corrosion resistance is not satisfactory. Above a Si content of 7% by weight, the corrosion resistance is increased, but the workability is lowered, and cracks may appear at the hot working and the cold working. Thus, the Si content is restricted to more than 5% by weight but not more than 7% by weight, preferably 5.5 to 6.5% by weight.

Mn: The element utilized as a deoxidizing agent at the melting step is Mn. In industrial scale production, usually not more than 2% by weight of Mn must be contained, but a satisfactory workability, a good weldability and a good corrosion resistance can be maintained up to 10% by weight as an austenite substituent element for the expensive Ni element. Above 10% by weight, satisfactory corrosion resistance cannot be obtained. Thus, the Mn content is restricted to not more than 10% by weight.

Cr: The corrosion resistance is generally increased with increasing Cr content. The present steel must have a good corrosion resistance in an atmosphere of nitric acid of high concentrations and high temperatures. Accordingly, a satisfactory corrosion resistance to that atmosphere can be obtained, if the Cr content is not less than 7% by weight. Below 7% by weight the corrosion resistance to nitric acid is not satisfactory, while above 16% by weight, the proportion of ferrite phase is increased, making the present steel hard, and consequently impairing the workability and weldability. Thus, the Cr content is restricted to 7–16% by weight ($7\% \leqq Cr \leqq 16\%$), preferably 8–14.5% by weight, more preferably 10–12% by weight.

Ni: The necessary Ni content for balancing with Cr and Si to obtain an austenite structure containing a small proportion of martensite or ferrite structure and consequently obtain a good weldability and a good workability is 10 to less than 19% by weight. Thus, the Ni content is restricted to $10\% \leqq Ni < 19\%$ by weight. Particularly in a range of $16\% \leqq Cr \leqq 18\%$ by weight, only the austenite phase is formed, and accordingly the hot workability and shaping formability are further improved.

Ti, Ta, Zr, and Ni: They are additional elements for stabilizing carbon, and at least one of these elements can be contained in an amount of not less than 4 times the carbon content (C% by weight) to prevent deteriorated corrosion resistance due to the sensitization at about 650° C. A content below 4 times the carbon content is not satisfactory, whereas above a content of more than 2% by weight the ferrite content is increased to deterorate the degree of microstructure purification and also deteriorate the corrosion resistance. Thus, the content is restricted to from $4 \times C\%$ to 2% by weight. Among these elements, particularly a combination of Zr and Ti can improve the corrosion resistance owing to the action to stabilize carbon, and also can much improve the workability and weldability.

As described above, the present steel containing a lower Cr content than the Cr and Ni balance of the ordinary austenite stainless steel has a good hot workability and a good weldability which are most important in working into plate form materials, and mechanical properties equal to those of the ordinary austenite steinless steeel, and has a very excellent corrosion resistance to the nitric acid atmosphere at a high temperature and a high concentration. Thus, the present steel has less troubles in fabricating steel plates, a high product yield and a good economy as regards the components, and consequently has an industrially significant usefulness.

The present steel will be described in detail referring to Examples.

EXAMPLE 1

Results of corrosion tets in 98% concentrated nitric acid at 80° C. are shown in Table 3. Five repetitions of a test of test pieces dipped in a liquid phase and a gas phase in equilibrium with the liquid phase of 98% concentrated nitric acid at 80° C. for 168 hours for one repetition were carried out. The test solution was renewed with a fresh solution at every repetition. The corrosion rate in the concentrated nitric acid atmosphere is sometimes increased with time, and thus as the value of corrosion rate, an average corrosion rate of the fourth repetition and fifth repetition ($g/m^2.hr$) was used.

It is seen from Table 3 that the present steels including both solution treated materials and sensitized materials had a very excellent corrosion resistance in both liquid phase and gas phase.

TABLE 3

| Test piece | | Corrosion rate ($g/m^2hr$) | | |
|---|---|---|---|---|
| No. | Heat treatment | liquid phase | gas phase | Remarks |
| 4 | 1050° C. × 15 min, AC* | 0.007 | 0.005 | Invention |
| " | 650° C. × 2 hr, AC | 0.116 | 0.057 | " |
| 5 | 1050° C. × 15 min, AC | 0.008 | 0.006 | " |
| " | 650° C. × 2 hr, AC | 0.145 | 0.097 | " |
| 39 | 1050° C. × 15 min, AC | 0.022 | 0.019 | Reference steel |
| " | 650° C. × 2 hr, AC | 0.250 | 0.108 | Reference steel |
| 40 | as received | 0.079 | 0.023 | Reference steel |
| " | 650° C. × 2 hr, AC | 0.432 | 0.465 | Reference steel |
| 41 | as received | 0.090 | 0.025 | Reference steel |
| " | 650° C, × 2 hr, AC | 2.571 | 0.524 | Reference steel |
| Carpenter-20 | as received | 15.16 | 29.31 | Reference steel |
| " | 750° C. × 2 hr, AC | 29.88 | 39.51 | Reference steel |
| SUS 304L | as received | 12.13 | 10.11 | Reference steel |
| " | 650° C. × 2 hr, AC | 89.31 | 51.40 | Reference steel |
| 1070 aluminum | as received | 2.151 | 4.362 | Reference material |

*AC = air-cooled

EXAMPLE 2

In a plant for concentrated nitric acid process for a producing 98% concentrated nitric acid by distilling 80–90% nitric acid, various test pieces were placed in a condenser for concentrated nitric acid gas at about 90° C., and subjected to corrosion tests at site for 2,327 hours. The results are shown in Table 4, where it is seen that the corrosion resistance of the present steel is considerably better.

TABLE 4

| Test piece | | Corrosion rate | |
|---|---|---|---|
| No. | Heat treatment | ($g/m^2hr$) | Remarks |
| 1070 aluminum | as received | completely dissolved | Reference material |
| 5052 aluminum | as received | completely dissolved | Reference material |
| SUS 304L | as received | completely dissolved | Reference steel |
| 40 | as received | 0.161 | Reference steel |
| " | 650° C. × 2 hr, AC* | 0.355 | Reference steel |
| 39 | 1050° C. × 15 min, AC | 0.088 | Reference steel |
| " | 650° C. × 2 hr, AC | 0.131 | Reference steel |
| 4 | 1050° C. × 15 min, AC | 0.013 | Invention |
| " | 650° C. × 2 hr, AC | 0.019 | " |
| 2 | 1050° C. × 15 min, AC | 0.022 | " |
| " | 650° C. × 2 hr, AC | 0.044 | " |
| 9 | 1050° C. × 15 min, AC | 0.018 | " |

TABLE 4-continued

| Test piece | | Corrosion rate | |
|---|---|---|---|
| No. | Heat treatment | ($g/m^2hr$) | Remarks |
| " | 650° C. × 2 hr, AC | 0.039 | " |

*AC = air-cooled

EXAMPLE 3

In a plant for concentrated nitric acid process for a producing 98% concentrated nitric acid by distilling 80–90% nitric acid, test heat exchangers for condensing and cooling concentrated nitric acid gas at about 90° C. were fabricated from the present steels (Nos. 4 and 24), respectively and used. No abnormal occurrences such as cracking, etc. were observed during the plate fabrication, bending to pipes, and welding. After use for about 10 months, inside inspection was carried out, but it was found that the surface state was not so changed as before the use, the welded parts were normal and had a good corrosion resistance.

Similar heat exchangers made from 1070 aluminum, and reference steels (Nos. 39 and 40) were also tested. Corrosion and thickness reduction of the 1070 aluminum were considerable after use for 23 days, a general corrosion took place in the reference steel (No. 40) after use for about 3 months, and also occurrence of preferential corrosion was observed at the welded metal part, and a surface clouding due to the general corrosion was developed in the reference steel (No. 39) after use for about three months. The corrosion resistance of the reference steels was inferior to that of the present steels.

EXAMPLE 4

A test distillation apparatus for distilling 80–90% nitric acid to withdraw a concentrated nitric acid gas from its top at about 40° C. and about 70% nitric acid solution from its bottom at about 85° C. was fabricated from the present steel (No. 24). No abnormal occurrence such as cracking, etc. was observed during the plate fabrication, bending and welding. As a result of actual use test for about 6 months, it was found that the present steel had a very good corrosion resistance even at the welded parts.

EXAMPLE 5

In an apparatus for removing $N_2O_4$ by blowing air of about 50° C. into 98% concentrated nitric acid containing $N_2O_4$ at about 40° C., actual corrosion tests for 3 months were carried out. The results are shown in Table 5. It was found that the present steel (No. 8) had a very good corrosion resistance.

TABLE 5

| Test piece | Corrosion rate ($g/m^2hr$) | Remarks |
|---|---|---|
| No. 39 (specimen welded by the same material rod) | 0.211 (preferential corrosion) | Reference steel |
| No. 8 (specimen welded by the same material rod) | 0.029 (sound welds) | Invention |
| 1070 aluminum (specimen welded by the same material rod) | 0.103 (preferential corrosion) | Reference material |

EXAMPLE 6

Miniature storage tanks for 98% concentrated nitric acid were fabricated from the present steels (Nos. 4 and 24). No abnormal occurrence such as cracking, etc. were observed during the fabrication of plate, bending and welding. As a result of storage tests of 98% concentrated nitric acid in the miniature storage tanks at about 30° C. for about 10 months, it was found that the present steels had the normal surface state as before the use even at the welded parts, and had a very good corrosion resistance without polluting the 98% concentrated nitric acid with dissolved metal ions.

EXAMPLE 7

Results of corrosion tests in boiling 98% concentrated nitric acid under atmospheric pressure are shown in Table 6. Test of exposing test pieces to the liquid phase and the gas phase for 20 hours was repeated 5 times, and the test solution was replaced with a fresh test solution at every repetition. Values of corrosion rate was average corrosion rates of the fourth repetition and fifth repetition ($g/m^2.hr$). Corrosion of reference steels having a small Si content was considerable, whereas the present steel had a better corrosion resistance.

TABLE 6

| Test piece (Heat treatment) | Corrosion rate ($g/m^2 . hr$) Liquid phase | Gas phase | Remarks |
|---|---|---|---|
| No. 35 (650° C. × 2 hr AC) | 1.32 | 33.61 | Reference steel |
| No. 36 (650° C. × 2 hr AC) | 0.99 | 9.55 | Reference steel |
| No. 5 (650° C. × 2 hr AC) | 0.03 | 0.11 | Invention |

EXAMPLE 8

Results of corrosion tests in 98% concentrated nitric acid at 80° C. are shown in Table 7. The test of exposing test pieces to a liquid phase and a gas phase for 168 hours was repeated 5 times. The test solution was replaced with a fresh test solution at every repetition. Values of the corrosion rate was average corrosion rates of the fourth repetition and fifth repetition ($g/m^2.hr$). A good corrosion resistance was obtained at the Mn content of not more than 10% by weight, particularly 3% by weight or less, but the corrosion resistance was lowered above 10% by weight.

TABLE 7

| Test piece (Heat treatment) | Corrosion rate ($g/m^2 . hr$) Liquid phase | Gas phase | Remarks |
|---|---|---|---|
| No. 6 (650° C. × 2 hr AC) | 0.024 | 0.011 | Invention |
| No. 10 (650° C. × 2 hr AC) | 0.025 | 0.010 | " |
| No. 11 (650° C. × 2 hr AC) | 0.024 | 0.013 | " |
| No. 12 (650° C. × 2 hr AC) | 0.035 | 0.022 | " |
| No. 13 (650° C. × 2 hr AC) | 0.073 | 0.031 | " |
| No. 36 (650° C. × 2 hr AC) | 0.121 | 0.063 | Reference steel |
| No. 37 (650° C. × 2 hr AC) | 0.154 | 0.092 | Reference steel |

EXAMPLE 9

Results of corrosion tests of sensitized steels in a severe state as to the corrosion in 98% concentrated nitric acid at 80° C. are shown in Table 8. The test of exposing test pieces to a liquid phase and a gas phase for 168 hours was repeated 5 times, and the test solution was replaced with a fresh test solution at every repetition. Values of corrosion rates were averages of corrosion rates of the fourth repetition and the fifth repetition ($g/m^2.hr$).

The present steels had a small corrosion rate even in the sensitized state and had a good corrosion resistance. Among these steels, the steel species containing Ti, Ta, Zr and Nb had a more improved corrosion resistance.

TABLE 8

| Test piece (Heat treatment) | Corrosion rate ($g/m^2 . hr$) Liquid phase | Gas phase | Remark |
|---|---|---|---|
| No. 5 (650° C. × 2 hr AC) | 0.145 | 0.097 | Invention |
| No. 20 (650° C. × 2 hr AC) | 0.016 | 0.013 | " |
| No. 16 (650° C. × 2 hr AC) | 0.013 | 0.011 | " |
| No. 19 (650° C. × 2 hr AC) | 0.013 | 0.011 | " |
| No. 18 (650° C. × 2 hr AC) | 0.021 | 0.016 | " |
| No. 23 (650° C. × 2 hr AC) | 0.026 | 0.013 | " |
| No. 22 (650° C. × 2 hr AC) | 0.015 | 0.009 | " |
| No. 21 (650° C. × 2 hr AC) | 0.019 | 0.012 | " |
| No. 24 (650° C. × 2 hr AC) | 0.012 | 0.010 | " |

What is claimed is:

1. A high-silicon-nickel-chromium steel resistant to concentrated nitric acid with a good workability and a good weldability, consisting essentially of carbon in an amount of not more than 0.02% ($C \leqq 0.02\%$), silicon in an amount of from more than 5% to not more than 7% ($5\% < Si \leqq 7\%$), manganese in an amount of not more than 10% ($Mn \leqq 10\%$), chromium in an amount of from not less than 8% to not more than 14.5% ($8\% \leqq Cr \leqq 14.5\%$), nickel in an amount of from not less than 16% to not higher than 18% ($16\% \leqq Ni \leqq 18\%$), and the balance being iron and inevitable impurities, percentages being by weight.

2. The steel according to claim 1, wherein the content of silicon is from not less than 5.5% by weight to not more than 6.5% by weight ($5.5\% \leqq Si \leqq 6.5\%$).

3. The steel according to claim 1, wherein the content of nickel is from not less than 16% by weight to not more than 18% by weight ($16\% \leqq Ni \leqq 18\%$), the content of chromium is from not less than 8% by weight to not more than 14.5% by weight ($8\% \leqq Cr \leqq 14.5\%$), and the content of silicon is from not less than 5.5% by weight to not more than 6.5% by weight ($5.5\% \leqq Si \leqq 6.5\%$).

4. A high-silicon-nickel-chromium steel resistant to concentrated nitric acid with a good workability and a good weldability, consisting essentially of carbon in an amount of not more than 0.02% ($C \leqq 0.02\%$), silicon in an amount of from more than 5% to not more than 7% ($5\% < Si \leqq 7\%$), manganese in an amount of not more than 10% ($Mn \leqq 10\%$), chromium in an amount of from not less than 8% to not more than 14.5% ($8\% \leqq Cr \leqq 14.5\%$), nickel in an amount of from not less than 16% to not higher than 18% ($16\% \leqq Ni \leqq 18\%$), and at least one additional element selected from the group consisting of titanium (Ti), tantalum (Ta), zirconium (Zr) and niobium (Nb) in an amount of from not less than 4 times the amount of carbon to not more than 2% and the balance being iron and inevitable impurities, percentages being by weight.

5. The steel according to claim 4, wherein the additional element is a combination of zirconium and titanium.

* * * * *